US007048011B2

(12) United States Patent
DeMoore et al.

(10) Patent No.: US 7,048,011 B2
(45) Date of Patent: May 23, 2006

(54) PRINTING PRESS CYLINDER FLEXIBLE JACKET COVERING

(75) Inventors: Howard W. DeMoore, Dallas, TX (US); James A. Elliott, Euless, TX (US)

(73) Assignee: Printing Research, Inc., Dallas, TX (US)

( * ) Notice: Subject to any disclaimer, the term of this patent is extended or adjusted under 35 U.S.C. 154(b) by 321 days.

(21) Appl. No.: 10/660,050

(22) Filed: Sep. 10, 2003

(65) Prior Publication Data

US 2005/0051229 A1 Mar. 10, 2005

(51) Int. Cl.
*D03D 5/00* (2006.01)
*B65H 39/02* (2006.01)

(52) U.S. Cl. ..... 139/54; 139/407; 101/422; 101/419

(58) Field of Classification Search ..... 139/54, 139/407; 101/422, 419
See application file for complete search history.

(56) References Cited

U.S. PATENT DOCUMENTS

| | | | | |
|---|---|---|---|---|
| 3,083,738 | A * | 4/1963 | Erwin et al. | 139/434 |
| 3,951,177 | A | 4/1976 | Santucci | 139/431 |
| 4,090,535 | A | 5/1978 | Nakanishi | 139/434 |
| 4,143,679 | A * | 3/1979 | Luber | 139/383 R |
| 4,178,971 | A | 12/1979 | Malasek | 139/435 |
| 4,193,427 | A | 3/1980 | Shindo | 139/54 |
| 4,402,267 | A * | 9/1983 | DeMoore | 101/419 |
| 4,421,141 | A | 12/1983 | Brouwer | 139/54 |
| 4,527,598 | A | 7/1985 | Walch | 139/435 |
| 4,909,283 | A | 3/1990 | Verclyte | 139/1 |
| 5,080,143 | A | 1/1992 | Bertsch | 139/434 |
| 5,907,998 | A | 6/1999 | DeMoore | 101/232 |
| 6,129,123 | A | 10/2000 | Ludwig | 139/116.2 |
| 6,209,588 | B1 | 4/2001 | Reinhardt | 139/194 |
| 6,227,253 | B1 | 5/2001 | Meyns | 139/54 |
| 6,240,975 | B1 | 6/2001 | Hehle | 139/434 |
| 6,244,178 | B1 * | 6/2001 | DeMoore et al. | 101/401.1 |
| 6,321,796 | B1 | 11/2001 | Sawada | 139/434 |
| 6,325,111 | B1 | 12/2001 | Nakada | 139/434 |

FOREIGN PATENT DOCUMENTS

| | | |
|---|---|---|
| CH | 344317 A | 9/1946 |
| WO | PCT/US2004/029113 | 2/2005 |

OTHER PUBLICATIONS

PCT Written Opinion of the International Searching Authority, Feb. 25, 2005.

* cited by examiner

*Primary Examiner*—John J. Calvert
*Assistant Examiner*—Robert H Muromoto
(74) *Attorney, Agent, or Firm*—Michael W. Piper; Conley Rose, P.C.

(57) ABSTRACT

A flexible jacket covering for a printing press transfer cylinder having a low density selvage for attaching one edge of the jacket to a hook and loop attachment strip on the transfer cylinder. The covering is cut from fabric woven on a shuttleless loom. The fabric has a reduced density selvage formed by reducing the density of warp threads in the selvage is no more than the warp thread density in the body of the covering fabric and preferably to about half the warp thread density in the body of the fabric.

23 Claims, 3 Drawing Sheets

PRINTING PRESS CYLINDER FLEXIBLE JACKET COVERING

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to printing presses and more particularly to an improved flexible jacket covering for a transfer cylinder.

BACKGROUND OF THE INVENTION

In the operation of a multi-unit rotary offset printing press, freshly printed substrates such as sheets or web material are guided by transfer cylinders or the like from one printing unit to another, and then they are delivered to a sheet stacker or to a sheet folder/cutter unit, respectively. Transfer cylinders are know by various names including delivery cylinders, transfer rollers, support rollers, delivery wheels, skeleton wheels, segmented wheels, transfer drums, support drums, spider wheels, support wheels, guide wheels, guide rollers, etc. The ink marking problem inherent in transferring freshly printed substrates have been longstanding. Numerous efforts to solve the ink marking have been made. Some of them are discussed in U.S. Pat. Nos. 4,402,267 and 6,244,178, which are hereby incorporated for all purposes.

U.S. Pat. No. 4,402,267, disclosed an anti-marking fabric covering system for transfer cylinders. The system included the use of a low friction coating on the supporting surface of a transfer cylinder, over which was loosely attached a movable fabric covering. A suitable fabric covering was a loosely woven, lightweight cotton material such as gauze. The fabric was prepared by washing in water in the presence of a suitable fabric softener dissolved in the water. After the fabric was dried, a suitable fabric protector was applied to enhance the liquid repellency characteristics of the material. The fabric could then be attached to the transfer cylinder by the use of fastener strips such as the hook portion of a hook and loop type fastener system such as that made under the trademark VELCRO.

U.S. Pat. No. 6,244,178 disclosed numerous improvements to the flexible jacket covering. It disclosed use of cotton cheesecloth which is bleached, dyed, treated with an ink repellent and treated with an antistatic ionic polymer compound or otherwise rendered conductive. The covering was also preferably prestretched, and cut to a size having length and width dimensions corresponding to dimensions of a transfer cylinder, or in some embodiments to the smallest sheet size that is expected to be printed. The flexible jacket covering was then attached to the transfer cylinder by pressing onto VELCRO fastener strips which were attached to the cylinder.

The flexible jacket coverings used in the two above referenced patents were originally made from fabric woven on conventional shuttle looms. With shuttle looms, the weft threads are continuous and are woven back and forth through the loom shed. At each edge of the fabric, the weft threads form a loop around the outermost warp threads, thereby forming a stable edge which will not unravel even when it is processed as described above.

The textile industry has been changing to shuttleless looms which are also referred to as fluid weft insertion looms, air jet looms, etc. As the names suggest, these looms do not use a mechanical shuttle. Instead, they use air jets to insert weft threads into and across the shed of warp threads. With this type of loom, the weft threads are inserted as separate segments of thread extending across the loom and having free ends at each edge of the fabric. To prevent unraveling at the edges, various systems have been developed for forming a selvage along the edges of the fabric. One way of forming a selvage is to provide an extra length of thread at the end of each weft thread and to fold it back into the shed along with the insertion of the next weft thread. The tucking method may be combined with other techniques, such as leno stitches, to provide a stronger selvage.

As discussed in U.S. Pat. Nos. 4,402,267 and 6,244,178, a fabric preferred for use as flexible jacket coverings is a loosely woven cotton fabric like gauze or cheesecloth having a thread density of about 32 threads per inch in the warp direction and about 28 threads per inch in the weft direction. In order to form a strong selvage in loose weave fabric, it is standard practice in the textile industry to substantially increase the density of warp threads in the selvage area of the fabric. For example, two threads may be included in each dent in the selvage area, thus increasing the warp thread density to about 64 threads per inch. With a warp thread density such as this, the tucked weft threads are firmly held in the selvage and do not unravel as the fabric is processed to become a flexible jacket covering.

While the conventional selvage works as intended to prevent unraveling, it has created problems in the making and use of flexible jacket coverings. As indicated above, the woven fabric is processed through a number of steps in the making of flexible jacket coverings. It is desirable to use all of the processed fabric to avoid waste. One way of avoiding waste is to include the selvage as part of the flexible jacket covering. With the fabric woven on shuttle looms, the original fabric edge was used as a jacket covering edge which was attached to the VELCRO fastener strips. However, with fabric woven on shuttleless looms, the conventional high-density selvage has proven to be less suitable for attachment to the VELCRO fastener strips. The high-density selvage typically will not grip if attached with normal hand pressure. If enough force is used to form a tight grip on the VELCRO strips, then it is difficult to remove the jacket coverings when they need to be replaced. As a result, it has been found necessary to cut the selvage from the fabric and use a portion of the body of the cloth to attach to the VELCRO fastener strips. The fabric must have a hem stitch sewed along the cut edge to avoid unraveling of the cut edge during processing and handling. Thus the conventional shuttleless loom high density selvage causes less efficient use of the fabric and requires an additional process step.

SUMMARY OF THE INVENTION

A flexible jacket covering of the present invention includes a shuttleless loom woven fabric having a reduced density selvage. The warp thread density in the selvage is about the same as, or less than, the density in the body of the fabric.

In one embodiment, the reduced density of the selvage is achieved by having only one warp thread per dent, instead of two per dent in a conventional selvage, and by skipping, or having no threads, in alternate dents. In one embodiment, the outermost dent has two threads.

DETAILED DESCRIPTION OF THE PREFERRED EMBODIMENTS

Figure 1:
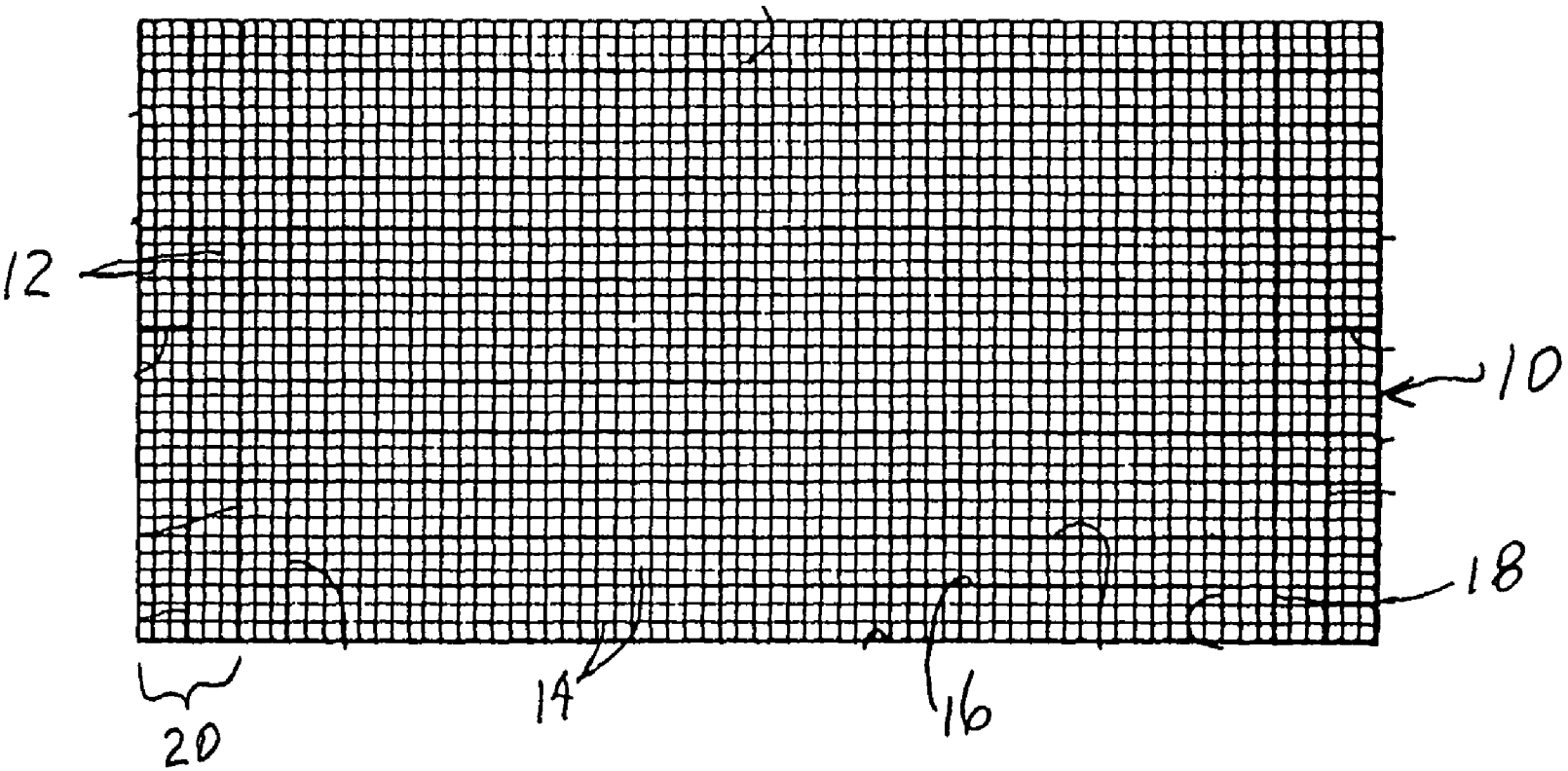
FIG. 1 is an illustration of a flexible jacket covering.

FIG. 1 illustrates an embodiment of a flexible jacket covering 10 according to the present invention. This embodiment is similar to an embodiment of the above referenced U.S. Pat. No. 6,244,178. The flexible jacket covering in this embodiment is made of a natural material such as cotton, hemp, wool, silk, linen and the like. A suitable embodiment uses cotton cheesecloth having a weave of thirty-two plus or minus two warp threads 14 per inch and twenty-eight plus or minus two weft or fill threads 12 per inch. The fabric is preferably bleached, dyed, treated with an ink-repellant compound and, in some embodiments, rendered conductive. Conductivity may be achieved by including conductive weft strands 16 and/or conductive warp strands 18. In a preferred embodiment, most of the threads 12, 14, are of the same color, e.g. blue. It is also preferred to include some threads contrasting color to form alignment stripes on the flexible jacket covering. The conductive strands 16 and 18 may be formed of copper to conveniently form such alignment stripes. Alternatively, alignment stripes may be provided by threads dyed a color, for example black or white, which contrasts with the color, e.g. blue, of the majority of the threads forming the covering 10.

Figure 2:
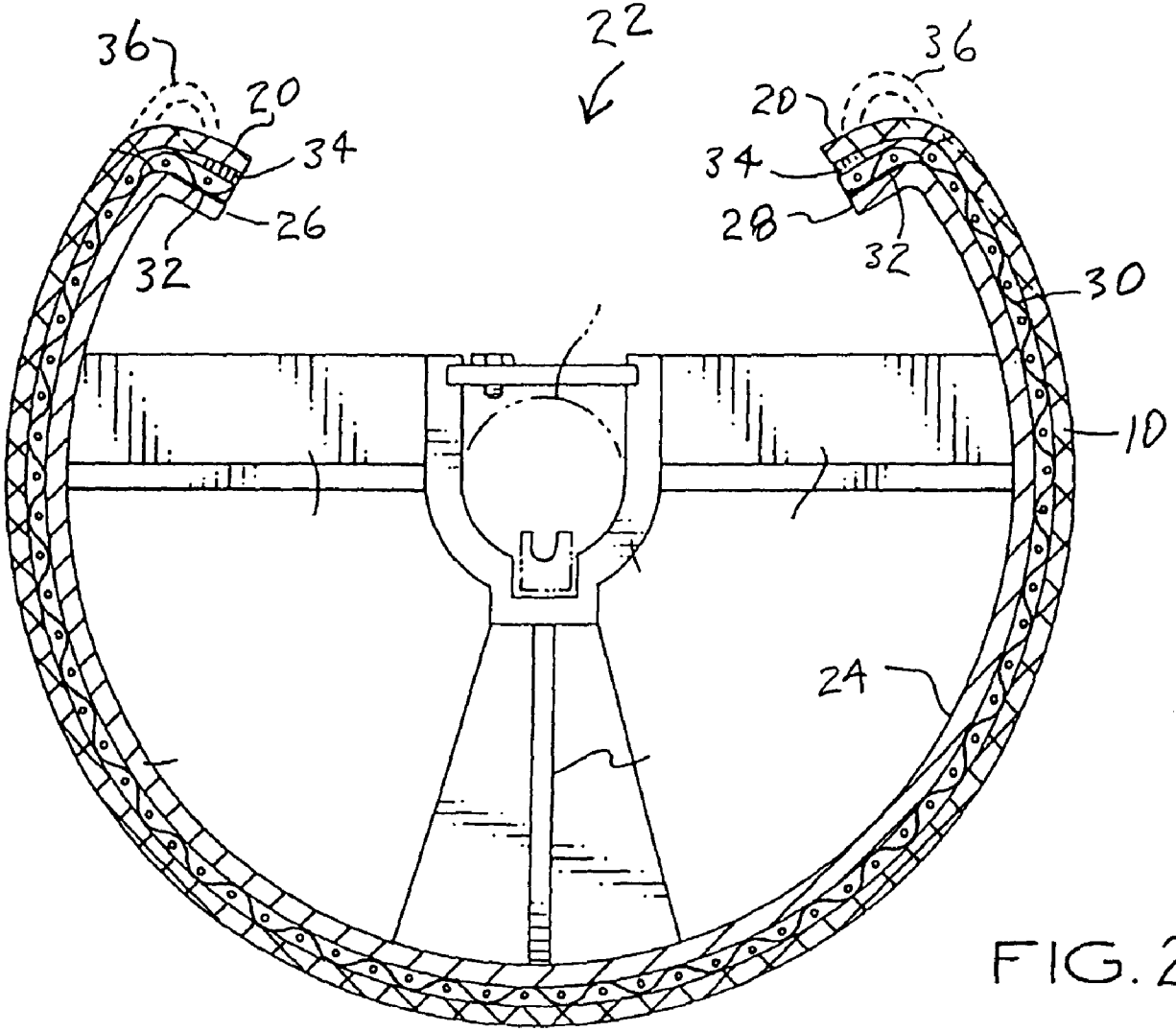
FIG. 2 is a cross sectional view of a printing press transfer cylinder with a flexible jacket covering attached.

FIG. 2 provides a cross sectional view of a typical transfer cylinder 22 with a flexible jacket covering 10 installed in an operative position. The cylinder 22 includes a metal cylinder 24 having areas 26 and 28 for attaching cylinder coverings. The areas 26, 28 may be flanges as illustrated or may be areas on the back or front side of the cylinder 24 which do not contact the substrate which is transferred by the cylinder. In this embodiment, the cylinder 22 includes a low friction, conductive cylinder base covering 30 attached to the flanges 26 and 28 by adhesive deposits 32, but may be attachd by mechanical means if desired. A pair of fastener strips 34 are attached to the edges of the base covering 30 over the attachment areas 26, 28. The strips are preferably the male or hook portion of a VELCRO hook and loop fastener system. If the base covering 30 is not used, the fastener strips 34 may be attached directly to the attachment areas 26, 28. The flexible jacket covering 10 is attached to the cylinder 22 by using hand pressure to press end portions 20 of the covering 10 into contact with the fastener strips 34. As illustrated by dashed lines 36, the covering 10 is preferably cut to a size which allows circumferential sliding of the jacket 10 relative to the cylinder 22 and base covering 30.

The flexible jacket covering 10 is typically cut from a larger section of cloth to fit a particular printing press transfer cylinder. In some alternate embodiments, it may be cut to a width corresponding to substrates used in a particular printing job, which may be less than the full width of a press transfer cylinder. In any case, the jacket covering 10 is sized so that the two end portions 20 of the covering 10 will overlap the attachment strips 34 carried on the printing press transfer cylinder 22. In some cylinders, attachments strips may be provided along the sides of the cover as well as the ends. As discussed above, when the jacket 10 was woven on a shuttle type of loom, at least one end portion 20 was normally comprised of the original woven fabric edge. But if the fabric is woven on a shuttleless loom and a conventional high-density selvage is provided on the fabric, the selvage is difficult to use for either edge 20, because it does not properly adhere to a VELCRO fastener strip. In some printing presses, the transfer cylinder includes fastener strips for all four sides of the flexible jacket covering 10. In such cases, the selvage may be used for any of the four edges of the jacket.

Figure 3:
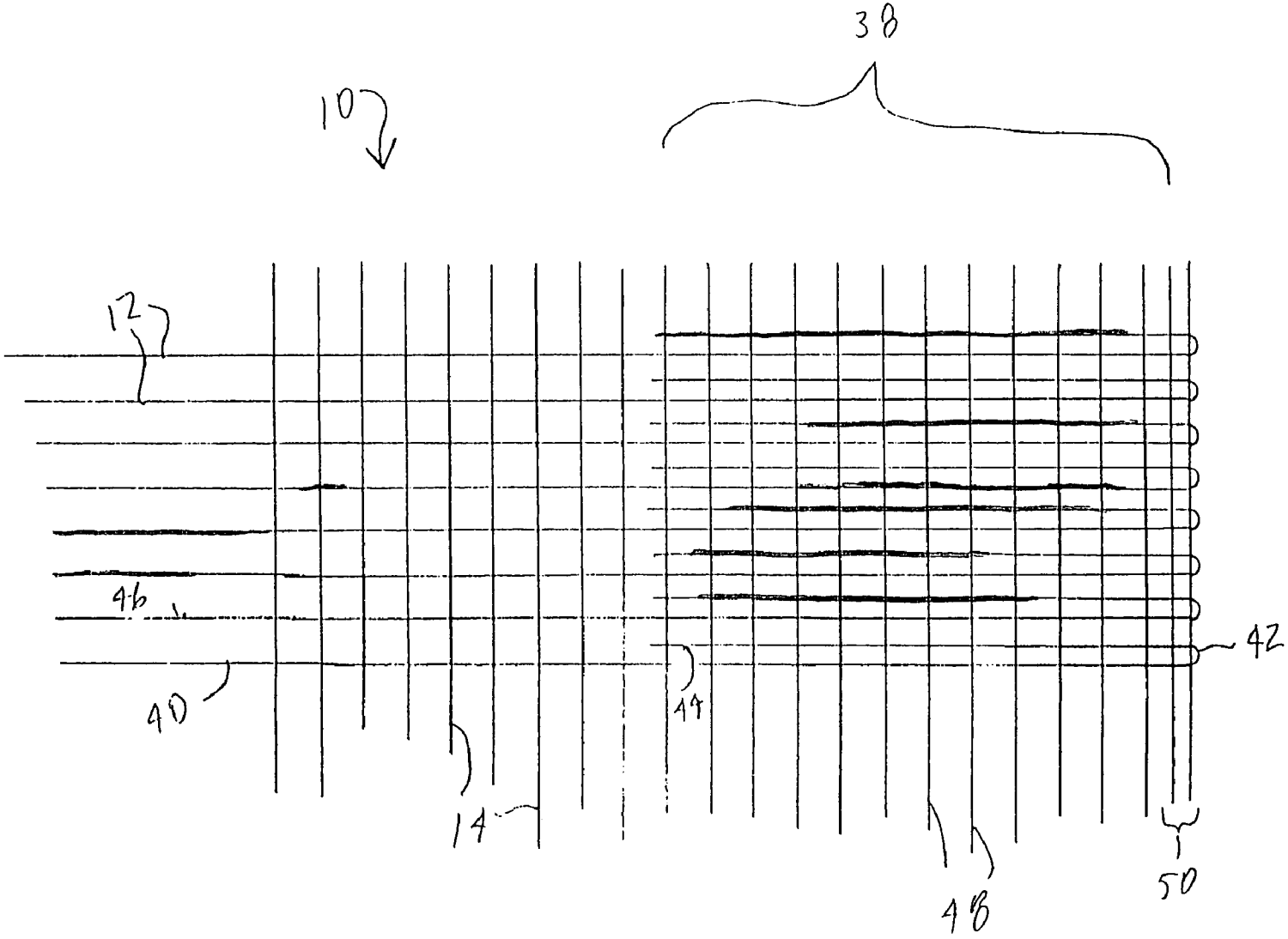
FIG. 3 is an enlarged view of a selvage forming part of the flexible jacket covering of FIG. 1.

FIG. 3 illustrates an improved selvage 38 for flexible jacket covering 10 embodiments according to the present invention. The warp threads 14 and weft threads 12 may be the same as shown in FIG. 1. The selvage 38 is the area at the edge of the fabric where weft threads 12 are tucked back into the shed of warp threads 14 during the weaving process. For example, weft thread 40 is folded back at the free side 42 of the selvage 38 and has an end 44 tucked back into the weave of warp threads 14. The end 44 is tucked at about the same time as the next weft thread 46 is inserted into the shed of warp threads 14. The end 44 and thread 46 therefore lie adjacent each other, that is they are not separated by a warp thread 14.

In a conventional selvage used with shuttleless looms, warp threads 48 in the selvage region 38 would be of increased density to ensure that the tucked weft thread ends, e.g. 44 are firmly held in position and kept from unraveling. This is normally done by including two threads per dent, instead of one as used in the body of the fabric. This results in at least double warp density. The tucked ends, e.g. 44, of the weft threads effectively doubles the weft density in the selvage area 38. The overall or total density of a fabric can be defined by the total number of thread crossings or intersections which occur in a given space, e.g. one square inch. This total density measurement is a good indicator of the tightness of the weave and therefore a good indicator of its ability to interact with or engage the VELCRO type of fastener. This total density value is the product of the warp thread density and the weft thread density. The combination of the increased warp density and increased weft density may increase the total thread crossing density to four times the total thread crossing density in the body of the fabric. For example, in the typical jacket covering fabric discussed above, the warp thread density in the body of the fabric is about thirty-two threads per inch and the weft thread density is about twenty-eight threads per inch for a total density of about 896 thread crossings per square inch in the body of the fabric. In a conventional selvage, the warp thread density is increased to about sixty-four threads per inch and the tucking of the weft threads effectively increases weft thread density to fifty-six threads per inch, for a total selvage density of about 3584 thread crossings per square inch or four times the density in the body of the fabric.

In one embodiment of the present invention, the density of warp threads 48 in the selvage area 38 is reduced relative to the normal high-density selvage density of two warp threads per dent. The density of warp threads may be reduced to the same density of one thread per dent, resulting in a density of about thirty-two warp threads per inch. When this warp thread density is combined with the double density of weft threads due to tucking, for example fifty-six threads per inch, the total fabric density in the selvage 38 is about 1792 thread crossings per square inch or twice the total thread density in the body of the fabric, but only about one-half the conventional density in the selvage 38.

In another embodiment, warp threads 48 in the selvage area 38 are not only limited to one per dent, but in one or more dents there are no warp threads, thus further reducing the warp thread density. For example, every fourth, third or second dent may be skipped to reduce warp thread density.

If every fourth dent is skipped, the total warp thread 48 density in the selvage 38 is reduced to three-fourths the density in the body of the fabric, or in the example used above about twenty-eight threads per inch. When this warp thread density is combined with the double density of weft threads due to tucking, the total fabric density in the selvage 38 is about 1568 thread crossings per inch.

If every third dent is skipped, the total warp thread 48 density in the selvage 38 is reduced to two-thirds the density in the body of the fabric, or in the example used above about twenty-one threads per inch. When this warp thread density is combined with the double density of weft threads due to tucking, the total fabric density in the selvage 38 is about 1176 thread crossings per inch.

If every second, i.e. every other, dent is skipped, the total warp thread 48 density in the selvage 38 is reduced to one-half the density in the body of the fabric, or in the example used above about sixteen threads per inch. When this warp thread density is combined with the double density of weft threads due to tucking, the total fabric density in the selvage 38 is about 896 thread crossings per inch, which is the same density as in the body of the fabric in this example.

In the most preferred embodiments, the total thread density, i.e. thread crossings per square inch, in the selvage 38 is reduced to about the same as in the body or the fabric. In these embodiments, the warp thread density in the selvage 38 is reduced considerably below levels recommended for shuttleless looms. The warp threads 48 in selvage 38 are preferably reduced to no more than one thread per dent and most preferably to less than one thread per dent by having no threads in alternate dents in the selvage 38. That is, the warp thread density in the selvage 38 is preferably reduced to about half the density in the body of the fabric. The one-half warp thread density combined with the tucked weft threads provides a total density of thread crossings per square inch about the same as in the body of the fabric. For example in an embodiment with thirty-two warp threads per inch in the body of the fabric, the selvage warp density is no more than thirty-two threads per inch and is preferably reduced to sixteen threads per inch. The total number of warp threads in the selvage area depends on the width of the selvage which may be less than an inch. For example, a one half inch wide selvage may have only eight warp threads.

In another embodiment, in the outermost dent at the free side 42, a pair of warp threads 50 are spaced at a density of two warp threads per dent. If desired, the two dents closest to the free side 42 may include two threads per dent. This increased density is believed to improve the tucking process of the weft threads at the free side 42 and to increase resistance to unraveling, while still providing substantially the entire selvage 38 with a reduced density about equal to that in the body of the fabric.

The reduced density selvage according to the present invention has been found to attach more easily, but firmly and releasably, to VELCRO attachments strips. The selvage area of the woven fabric may be used as part of the flexible jacket covering, instead of being cut off and wasted, and there is no need to add a hem stitch to the fabric edge.

Efforts to use shuttleless loom fabric with conventional selvages to make transfer cylinder jacket coverings were disappointing as discussed in the background section above. The conventional selvage with a total density in the range of 3584 thread crossings per square inch were difficult to attach to the VELCRO fastener strips. If sufficient force was used to make the attachment, the jacket coverings were difficult to remove.

In an initial effort to solve the problem, the warp thread density in the selvage was reduced to one thread per dent for a total density of about 1792 thread crossings per square inch. The resulting selvages were easier to attach to, and remove from, the VELCRO strips, but still required more effort than was required for the previous models made with shuttle loom fabric.

In continued efforts to improve the product, the warp thread density was further reduced by skipping some dents in the warp threads in the selvage area. When the density was reduced to one half, i.e. skipping every other dent, the resulting jacket covers could be attached and removed from transfer cylinders with efforts equivalent to the shuttle loomed fabric models. Thus, a total density of about 896 thread crossings per square inch provided the best results. Use of one double thread dent at the extreme edge of the fabric, i.e. at the free side of the selvage 38, had no noticeable adverse effect on the ability to attach and remove the jacket coverings, but provided more resistance to unraveling.

From experimental results, it appears that the total density of the fabric selvage should be less than about 1800 threads per square inch to provide satisfactory attachment to and removal from the VELCRO fastener strips. Better results can be achieved with total density of less than about 1600 threads per square inch or less than about 1200 threads per square inch. The best results appear to be achieved with total density of about 900 threads per square inch. The attachment and removal results were not noticeably affected by having two threads in one dent at the free side of the selvage, but resistance to unraveling was desirably improved.

While specific warp and weft thread densities are used in the embodiments discussed herein, other densities may be used if desired. It appears that it is the total density, i.e. number of thread crossings per square inch, which primarily affects the ability to attach the fabric to the VELCRO attachment strips. Other combinations of warp and weft thread densities which provide suitable total densities should work equally well.

While the present invention has been illustrated and described with reference to particular embodiments, it is apparent that various modifications and substitutions of equivalent components may be made within the scope of the present invention as defined by the appended claims.

We claim:

1. A jacket covering for a printing press transfer cylinder having at least one hook and loop fastener strip for attaching at least one edge of a jacket covering to the transfer cylinder, comprising:

fabric having a first warp thread density in a body portion of the fabric and having a selvage comprising tucked ends of weft threads and a density of warp threads no greater than the first warp thread density;

wherein the selvage forms at least one edge of the jacket covering positioned for attachment to the hook and loop fastener strip on the printing press transfer cylinder.

2. A jacket covering according to claim 1, wherein the selvage comprises a warp thread density of no more than three-fourths the first warp thread density.

3. A jacket covering according to claim 1, wherein the selvage comprises a warp thread density of one-half the first warp thread density.

4. A jacket covering according to claim 1, wherein the first warp thread density is less than fifty threads per inch.

5. A jacket covering according to claim 1, wherein the first warp thread density is about thirty-two threads per inch.

6. A jacket covering according to claim 1, further comprising one dent adjacent a free side of the selvage having about twice the first warp thread density.

7. A jacket covering for a printing press transfer cylinder having at least one hook and loop fastener strip for attaching at least one edge of a jacket covering to the transfer cylinder, comprising:

fabric having a selvage comprising tucked ends of weft threads and a total density of less than about 1800 thread crossings per square inch.

8. A jacket covering according to claim 7, wherein the selvage has a total density of less than about 1600 thread crossings per square inch.

9. A jacket covering according to claim 7, wherein the selvage has a total density of less than about 1200 thread crossings per square inch.

10. A jacket covering according to claim 7, wherein the selvage has a total density of less than about 900 thread crossings per square inch.

11. A jacket covering according to claim 7, wherein the selvage has a warp thread density of less than about 32 threads per inch.

12. A jacket covering according to claim 7, wherein the selvage has a warp thread density of less than about 28 threads per inch.

13. A jacket covering according to claim 7, wherein the selvage has a warp thread density of less than about 21 threads per inch.

14. A jacket covering according to claim 7, wherein the selvage has a warp thread density of about 16 threads per inch.

15. A jacket covering according to claim 7, wherein the selvage has a warp thread density of about 64 threads per inch in at least one dent at a free side of the selvage.

16. A method for making a jacket covering for a printing press transfer cylinder having at least one hook and loop fastener strip for attaching at least one edge of a jacket covering to the transfer cylinder, comprising:

weaving fabric having a first warp thread density in a body portion of the fabric and having a selvage comprising tucked ends of weft threads and a density of warp threads in the selvage no greater than the first warp thread density, and cutting a jacket covering from a portion of the fabric, said portion comprising a portion of the selvage, said portion of the selvage forming the at least one edge of the jacket covering positioned for attaching to the hook and loop fastener strip on the printing press transfer cylinder.

17. A method according to claim 16, further comprising attaching the jacket covering to a transfer cylinder by pressing the selvage portion of the jacket covering onto a hook and loop fastener strip on a jacket covering of a transfer cylinder.

18. A method according to claim 16, wherein the density of warp threads in the selvage is about one half the first warp thread density.

19. A method for making a jacket covering for a printing press transfer cylinder having at least one hook and loop fastener strip for attaching at least one edge of a jacket covering to the transfer cylinder, comprising:

weaving fabric having a first warp thread density in a body portion of the fabric and having a selvage comprising tucked ends of weft threads and a total density of less than about 1800 thread crossings per square inch, and cutting a flexible jacket from a portion of the fabric, said portion comprising a portion of the selvage.

20. A method according to claim 19, further comprising attaching the jacket covering to a transfer cylinder by pressing the selvage portion of the jacket covering onto a hook and loop fastener strip on a jacket covering of a transfer cylinder.

21. A method according to claim 19, wherein the selvage total density is less than about 900 thread crossings per square inch.

22. A method according to claim 16, further comprising weaving the fabric on a shuttleless loom.

23. A method according to claim 19, further comprising weaving the fabric on a shuttleless loom.

* * * * *